US005310351A

United States Patent [19]

McAdow et al.

[11] Patent Number: 5,310,351

[45] Date of Patent: May 10, 1994

[54] RELAY SUPPORT CIRCUIT BOARD UNIT

[76] Inventors: Theodore McAdow, 806 Hyannis Port S., Crosby, Tex. 77532; Ralph G. Dennett, 20 Bartlett Rd., Brentwood, N.H. 03833

[21] Appl. No.: 968,394

[22] Filed: Oct. 29, 1992

[51] Int. Cl.[5] ..... H01R 13/00; H01R 9/09

[52] U.S. Cl. ..... 439/74; 439/485

[58] Field of Search ..... 439/56, 58, 196, 485, 439/486, 74, 76; 361/383, 384, 400, 413

[56] References Cited

U.S. PATENT DOCUMENTS

| | | | |
|---|---|---|---|
| 2,142,705 | 1/1939 | Tarr | 439/620 |
| 2,744,214 | 5/1956 | Di Marco et al. | 439/56 |
| 2,907,926 | 10/1959 | Slack . | |
| 3,459,998 | 8/1969 | Focarile . | |
| 3,551,874 | 12/1970 | Volinskie | 439/76 |
| 3,904,934 | 9/1975 | Martin . | |
| 4,218,724 | 8/1980 | Kaufman | 439/74 |
| 4,685,753 | 8/1987 | Isshiki et al. | 439/74 |
| 4,738,024 | 4/1988 | Eberhardt | 439/74 |
| 4,791,290 | 12/1988 | Noone et al. | 439/487 |
| 4,929,185 | 5/1990 | Wong et al. | 439/74 |
| 4,950,170 | 8/1990 | Miller, Jr. | 439/74 |
| 5,018,982 | 5/1991 | Speraw et al. | 439/74 |

OTHER PUBLICATIONS

"What's Wrong with Plug-In Relays," Electrical Manufacturing, pp. 148-151, Apr. 1957.

McAtee, D. J., Dual-In-Line Package Socket "Piggyback" Structure, IBM Tech. Disclosure Bull., vol. 16, No. 4, Sep. 1973.

*Primary Examiner*—P. W. Echols

*Attorney, Agent, or Firm*—Ian C. McLeod

[57] ABSTRACT

A mounting assembly 10 for a relay 12 is described. The assembly includes a support base 14 upon which is mounted a printed circuit board 17 with terminals 23 extending through the support base 14 and the board 17. An electrical connector 20 is mounted onto the board 17 with the pins 20A of the electrical connector 20 extending through openings 21 in the board 17 into an aperture 16C in the support base 14. A space 25 is provided between the first side 20F of the electrical connector 20 and the top surface 17A of the board 17 to allow the passage of air around the pins 20A to provide cooling. A relay 12 is mounted onto sockets 34 in the connector 20 and secured into place by a retainer bar 36.

9 Claims, 2 Drawing Sheets

RELAY SUPPORT CIRCUIT BOARD UNIT

Figure 1:
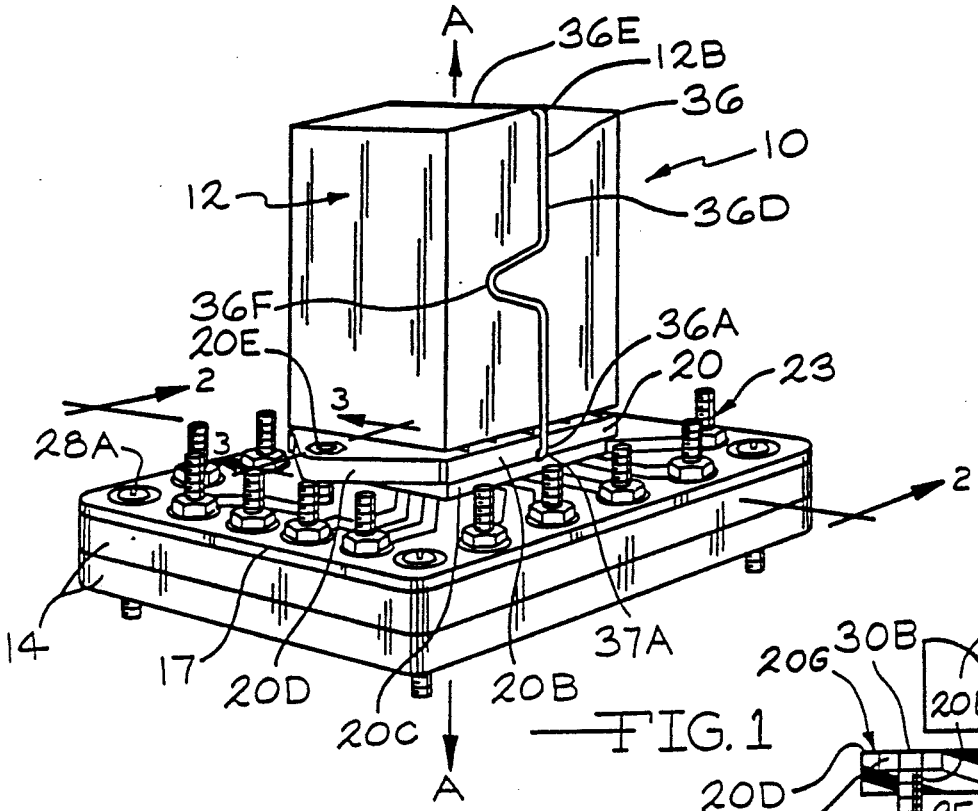

BACKGROUND OF THE INVENTION (1) Field of the Invention

The present invention relates to a mounting assembly for a relay. In particular, the invention relates to an assembly wherein the relay mounts on a connector which is mounted through a printed circuit board with a space provided between the circuit board and the connector such as to allow for air passage for cooling of the connector pins.

(2) Prior Art

The prior art has shown various methods for connecting electronic circuitry particularly for use with printed circuit boards. Illustrative are U.S. Pat. Nos. 3,904,934 to Martin; 4,685,753 to Isshiki et al; 4,929,185 to Wong; 4,950,170 to Miller, Jr. and 5,018,982 to Speraw et al.

U.S. Pat. No. 3,459,998 to Focarile describes a modular circuit assembly which uses connector blocks to provide spacing between printed circuit boards so that air circulates between the spaced boards.

U.S. Pat. No. 2,907,926 to Slack describes a means for packaging electrical circuit assemblies where spacers are used to separate the metalized circuit boards and also to serve as connectors between the boards.

U.S. Pat. No. 4,738,024 to Eberhardt describes a heat dissipating assembly for solid state components and control circuitry where the printed circuit boards are enclosed in a housing and separated through the use of the conduits on the electronic components. The boards are spaced primarily to provide thermal insulation for the control circuitry from the power circuitry.

U.S. Pat. No. 4,218,724 to Kaufman described a circuit package where two substrates which contain electronic circuitry are spaced within the housing with one substrate serving to close the opening of the housing to allow for mounting of the housing adjacent to a heat sink. The substrate adjacent to the heat sink will advantageously contain the power circuitry.

Also of interest is U.S. Pat. No. 4,791,290 to Noone which describes a photoelectric control unit with a cooling chamber for cooling of the connector pins. The connector pins are designed such that a large amount of the surface area of the connector pins is in contact with the side and base walls of the chamber. The cooling chamber is also substantially filled with a heat transfer medium to conduct heat away from the pins and into the side and base walls.

The above prior art relates to the spacing of printed circuit boards usually to separate heat generating components from the other components. However, the thought is to cool the entire system through the use of heat sinks or the passage of air. The problem is that there is no effective way to provide cooling of an electrical connector mounted on a printed circuit board which provides an easy method of attachment for an electronic component such as a relay.

OBJECTS

It is an object of the present invention to provide a mounting assembly for a relay onto a printed circuit board which allows for cooling of the electrical connector pins through the passage of air over the pins. Further, it is an object of the present invention to provide an easy method for mounting a relay onto a circuit board. Still further, it is an object of the present invention to provide a compact mounting assembly which is easy to assemble. These and other objects will become increasingly apparent by reference to the following description and to the drawings.

IN THE DRAWINGS

FIG. 1 is a perspective view of the mounting assembly 10 with the relay 12 mounted onto the electrical connector 20.

Figure 2:
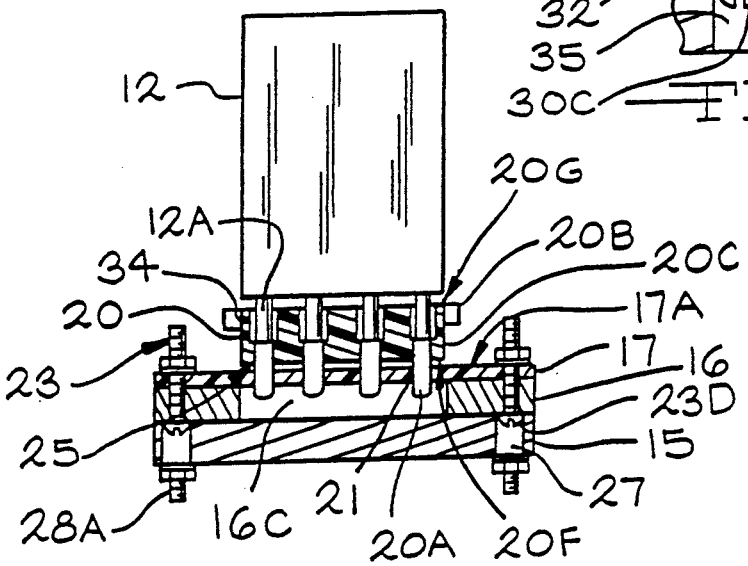

FIG. 2 is a cross-sectional view along the line 2—2 of FIG. 1 showing the space 25 between the printed circuit board 17 and the first side 20F of the connector 20 and showing the terminals 23 inserted through the board 17 and second support plate 16.

Figure 3:
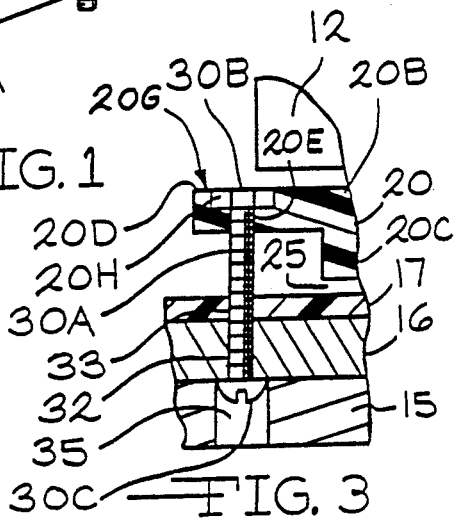

FIG. 3 is a cross-section view along the line 3—3 of FIG. 1 showing the mounting bolts 30A and mounting nuts 30B mounted through the second support plate 16 and the printed circuit board 17 and through the extension 20D of the electrical connector 20.

Figure 4:
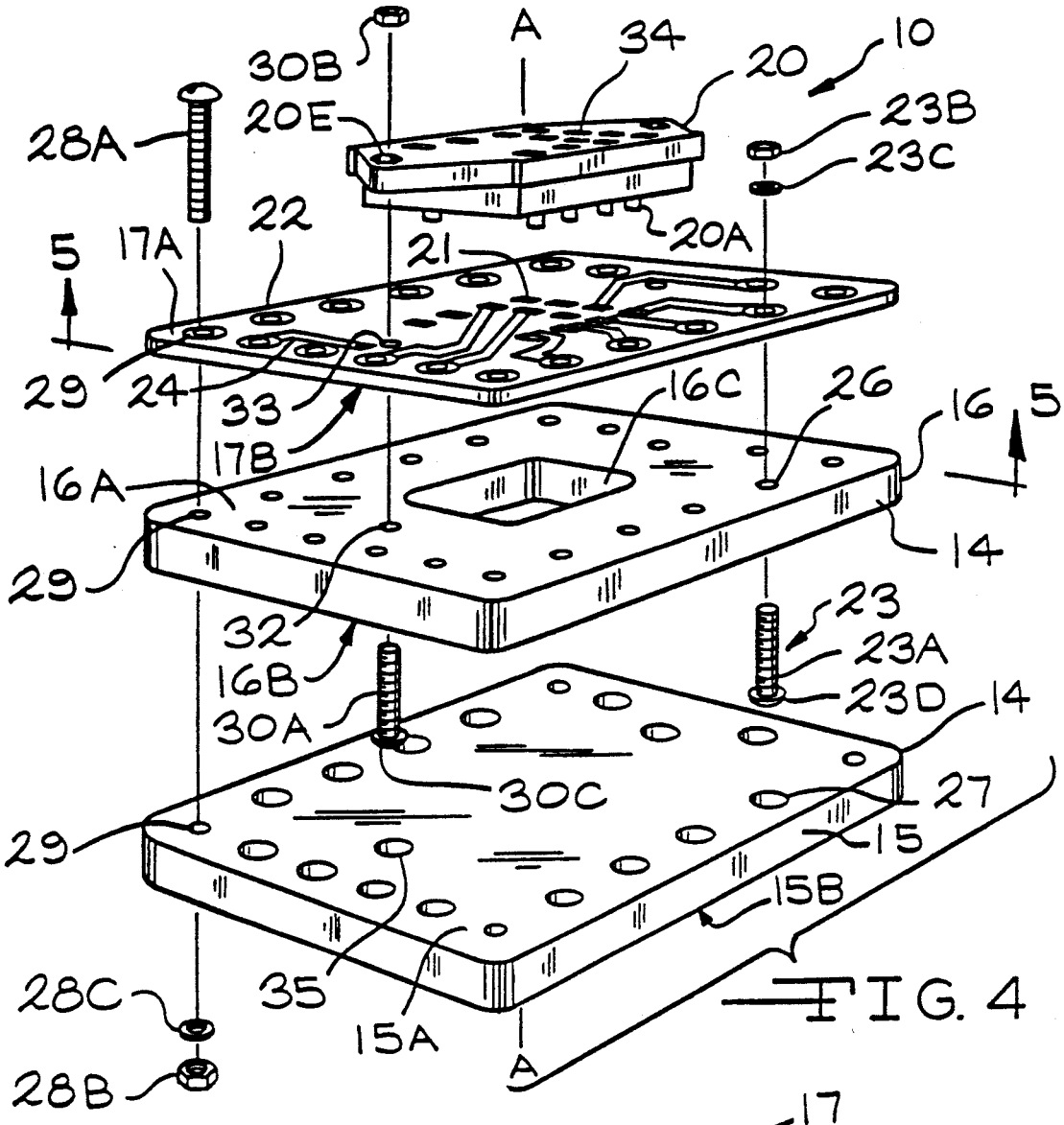

FIG. 4 is a separated view of the mounting assembly 10 without the relay 12 showing one of each of the terminals 23, the mounting bolts 30A and the securing bolts 28A.

Figure 5:
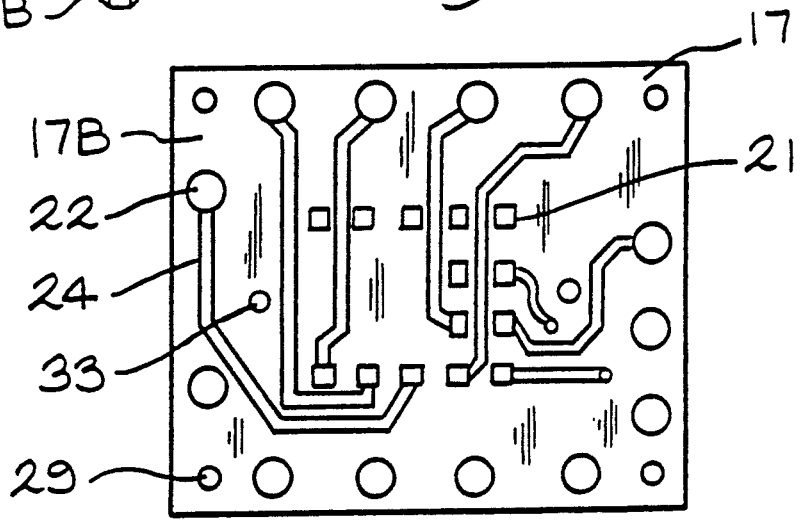

FIG. 5 is a bottom up perspective view along the line 5—5 of FIG. 4 showing the bottom surface 17B and leads 24.

GENERAL DESCRIPTION

The present invention relates to a mounting assembly for a relay which comprises: a flat printed circuit board with multiple terminals mounted around a periphery of the board, each terminal having a lead converging around a central portion of the board and ending at an opening in the board with a conductive material around the opening; an electrical connector with pins extending from a first side of the connector and sockets for mounting the relay on an opposite second side of the connector, the pins being secured in the openings in the board by the conductive material, wherein there is a space between the board and the first side 20F of the connector allowing passage of air to cool the pins; non-conductive support means mounting the board on a side of the board opposite the connector; and securing means for holding the support means and board together.

SPECIFIC DESCRIPTION

FIGS. 1 to 5 show the mounting assembly 10 for a relay 12 of the present invention. The mounting assembly 10 is comprised of a support base 14, a printed circuit board 17 provided with terminals 23, an electrical connector 20 and a relay 12. As seen in FIG. 4, the support base 14 is preferably rectangular in shape and comprised of a first support plate 15 and a second support plate 16. Preferably the support plates 15 and 16 are similar in shape and thickness and are formed from non-conductive material. Both support plates 15 and 16 are provided with a top side and a bottom side. The top side 15A of the first support plate 15 is mounted adjacent the bottom side 16B of the second support plate 16. The second support plate 16 is provided with an aperture 16C in the plane perpendicular to the axis A—A. The aperture 16C is of such a size as to accommodate the pins 20A of the electrical connector 20 which extend through openings 21 in the printed circuit board 17 as described in detail hereafter.

The printed circuit board 17 has a top surface 17A and a bottom surface 17B. The board 17 is mounted with the bottom surface 17B adjacent the top side 16A of the second support plate 16 and is preferably similar in shape and size. The circuit board 17 is provided with multiple terminal ports 22 around the periphery of the board 17. Each terminal port 22 has a lead 24 which converges around a central portion of the board 17 wherein the electrical connector 20 is to be mounted. As shown in FIGS. 4 and 5, the circuit board 17 is printed on both the top and bottom surface 17A and 17B with the lead 24 from a specific terminal port 22 being printed on a specific side. This double siding is to enable the board 17 to be more compact while retaining the same number of terminal ports 22. The number of terminal ports 22 will depend on the number of terminals 23 needed to represent the number of relay pins 12A of the relay 12 to be mounted in the electrical connector 20. The size of the circuit board 17 and thus the support plates 15 and 16 will necessarily depend on the number of terminal ports 22 required and the size of the relay 12 to be mounted.

In the preferred embodiment, the terminals 23 are mounted through the terminal ports 22 and are comprised of terminal bolts 23A and terminal nuts 23B. As seen in FIGS. 2 and 4, the terminal bolt 23A extends up through a terminal hole 26 in the second support plate 16 and into the terminal port 22 where the terminal nut 23B and terminal washer 23C are attached to the bolt 23A adjacent the top surface 17A of the board 17. Preferably, the terminal bolts 23A are not mounted through the first support plate 15, thus allowing the first support plate 15 to insulate the terminals 23 from the relay rack onto which the mounting assembly 10 is mounted. The coverage of the heads 23D of the terminal bolts 23A by the first support plate 15 also prevents the simultaneous touching of two or more heads 23D of the bolts 23 which eliminates the possibility of the shorting of the bolts 23A and thus the terminals 23. The first support plate 15 is provided with enlarged terminal apertures 27 located directly over the terminal holes 26 of the second support plate 16. The enlarged terminal apertures 27 of the first support plate 15 allow access to the heads 23D of the terminal bolts 23A without having to remove the first support plate 15. Preferably, the enlarged terminal apertures 27 of the first support plate 15 are not of a size to allow removal or insertion of the terminal bolts 23A through the first support plate 15. This requires that the terminals 23 be mounted through the second support plate 16 and the board 17 before the first support plate 15 is secured onto the assembly 10. The enlarged terminal aperture 27 allows for holding the bolt head 23D stationary while the terminal nut 23B is being tighten or loosened. The first support plate 15 also prevents the bolt 23A from falling out of the board 17 and second support plate 16 when the terminal nut 23B and terminal washer 23C are not attached. This set up is particularly necessary when connecting and disconnecting the terminals 23 for removal or connection of the assembly 20 from the device in which it is being used such as in the preferred embodiment in a gas fired turbine electrical generator.

The support base 14 and the board 17 are secured together through the use of securing bolts 28A. The securing bolts 28A are inserted through securing holes 29 in the support plates 15 and 16 and the board 17. The securing holes 29 are preferably situated in the four corners of the board 17 and the support plates 15 and 16. In the preferred embodiment, the securing bolts 28A are inserted first through the board 17 and then through the support plates 15 and 16. The securing bolts 28A are fastened through the use of securing nuts 28B and securing washers 28C mounted adjacent the bottom side 15B of the first support plate 15. The length of the securing bolts 28A is preferably longer than the width of the board 17 plus support base 14 such as to extend downward past the support base 14 to provide a method of providing space between the bottom side 15B of the first support plate 15 and the surface on which it is to be mounted.

As shown in FIG. 2, the electrical connector 20 has a bottom portion 20C with a first side 20F and a top portion 20B with a second side 20G. The first side 20F of the electrical connector 20 is mounted adjacent the top surface 17A of the board 17 over the aperture 16C in the second support plate 16. The bottom portion 20C of the electrical connector is preferably smaller in area than the top portion 20B and is roughly square in shape. The bottom portion 20C is of a surface area such as to accommodate the pins 20A of the connector 20. The pins 20A of the electrical connector 20 extend from the first side 20F of the connector 20 parallel to the axis A—A through openings 21 in the board 17 (FIG. 4) and into the aperture 16C in the second support plate 16 (FIG. 2). The pins 20A are held in the openings 21 in the board 17 by a conductive material. The openings 21 in the board 17 are located at the opposite end of the lead 24 from the terminal ports 22. The placement of the pins 20A in the openings 21 with conductive material enables the terminals 23 of the board 17 to be used to operate the relay 12. The pins 20A are secured in the openings 21 such that there is a space 25 between the first side 20F of the connector 20 and the top surface 17A of the board 17 (FIGS. 2 and 3). This space 25 allows for air flow between the board 17 and the connector 20 and over the pins 20A which cools the pins 20A. The width of the space 25 will depend on the length of the pins 20A, the required final height of the assembly 10 and the air flow necessary to sufficiently cool the pins 20A.

In the preferred embodiment, the top portion 20B of the connector 20, is larger and overhangs the bottom portion 20C of the connector 20. The top portion 20B is provided with extensions 20D on opposed sides of the connector 20. In the preferred embodiment as shown in FIG. 1, the extensions 20D are similar in shape to an equilateral triangle with one rounded apex of the triangle extending away from the center of the connector 20 perpendicular to the axis A—A. The extensions 20D are provided with mounting holes 20E parallel to the axis A—A located at the rounded apex of the extension 20D for further securing the connector 20 onto the board 17 and support base 14. As shown in FIG. 4, mounting bolts 30A extend up through first mounting holes 32 in the second support plate 16 and through second mounting holes 33 in the board 17 and finally into the mounting holes 20E in the extension 20D. A mounting nut 30B is secured adjacent the second side 20G of the connector 20. The exit opening 20H of the mounting hole 20E in the extension 20D, can be formed to accommodate the mounting nut 30B such that the top surface of the mounting nut 30B is flush with the second side 20G of the connector 20. In the preferred embodiment, the exit opening 20H of the mounting holes 20E in the second side 20G of the connector 20, is of a shape and size similar to that of the mounting nut 30B. Thus, the mounting nut 30B is prohibited from turning which allows the mounting bolt 30A to be removed without having to hold the mounting nut 30B. The first support plate 15 has enlarged mounting apertures 35 located directly over the heads 30C of the mounting bolts 30A. The enlarged mounting apertures 35 allow access to the heads 30C of the mounting bolts 30A, while preventing the mounting bolts 30A from falling out when the mounting nuts 30B are not attached. The enlarged mounting apertures 35 also prevent the mounting bolts 30A from being removed without first removing the first support plate 15. This arrangement is similar to that used with the terminal bolts 23A. In an alternate embodiment, the extensions 20D are similar in shape to a 90° triangle such that the top portion 20B of the electrical connector 20 is roughly trapezoidal in shape with the mounting holes 20E being parallel to the axis A—A located in the two extended corners corresponding to the 60° angle of the extensions 20D.

The second side 20G of the connector 20 is provided with sockets 34 which receive the pins 12A of the relay 12 when the relay 12 is mounted onto the electrical connector 20. The sockets 34 are connected to the connector pins 20A which are connected by leads 24 to the terminal ports 22 on the board 17. The relay 12 is easily mounted onto the connector 20 by sliding the relay pins 12A of the relay 12 into the sockets 34. The terminals 23 of the printed circuit board 17 act as conductive extensions of the relay pins 12A once the relay 12 is attached. The terminal ports 22 can be provided with labels to indicate which pin 12A of the relay 12 is associated with each terminal port 22.

The electrical connector 20 is equipped with a retainer bar 36 (FIG. 1). The retainer bar 36 is comprised of a thin rod of metal formed in the shape of an open ended rectangle with two side lengths 36D (one shown) and a top rod portion 36E. The ends of the retainer bar 36 are provided with L-shaped first and second hooks 36A and 36B (one shown). The first hook 36A of the retainer bar 36 is inserted within a first notch 37A in the top portion 20B of the connector 20 in a side adjacent the extension 20D. The second end 36B is inserted into a similar second notch 37B in the top portion 20B of the connector 20 on the opposite side of the connector 20 (not shown). The side lengths 36D of the retainer bar 36 are bent inward such that the first and second hooks 36A and 36B of the retainer bar 36, are spaced a shorter distance apart than the length of the top rod portion 36E of the retainer bar 36. To use the retainer bar 36, the relay 12 is mounted into the sockets 34 of the connector 20. The retainer bar 36 is positioned such that the first and second hooks 36A and 36B are lodged within the two notches 37 in the top portion 20B of the electrical connector 20 (FIG. 1). The retainer bar 36 is placed over the relay 12 creating a spring like tension which causes the side lengths 36D of the retainer bar 36 to be pressed tight against the relay 12. The retainer bar 36 is slipped over the top of the relay 12 until the top rod portion 36E comes to rest in an indentation 12B in the top of the relay 12. Loops 36F (one shown) located in the side lengths 36D of the retainer bar 36, allow the retainer bar to stretch over the top of the relay 12. The loops 36F contract and pull the top rod portion 36E of the retainer bar 36, down into the indentation 12B in the top of the relay 12 which secures the relay 12 into the electrical connector 20.

It is intended that the foregoing description be only illustrative of the present invention and that the present invention be limited only by the hereinafter appended claims.

I claim:

1. A mounting assembly for a relay which comprises:
(a) a flat printed circuit board with multiple terminals mounted around a periphery of the board extending upward from a top surface of the board, each terminal having a lead converging around a central portion of the board and ending at an opening in the board with a conductive material around each opening, wherein the terminals are a set of bolts mounted through the support means and board with nuts mounted on the bolts adjacent the top surface of the board;
(b) an electrical connector with pins extending from a first side of the connector and sockets for mounting the relay on an opposite second side of the connector, the pins being secured in the openings in the board by the conductive material, wherein there is a space between the top surface of the board and the first side of the connector allowing passage of air to cool the pins;
(c) non-conductive support means mounting the board on a bottom surface of the board opposite the connector; and
(d) securing means for holding the support means and board together.

2. The assembly of claim 1 wherein the connector has extensions on opposed sides and wherein bolts are mounted through the extensions and the board with nuts on the bolts to secure the connector in position relative to the board.

3. The assembly of claim 1 wherein the support means is a first flat plate with an opening around the pins which extend through and from the bottom surface of the board, wherein the terminals are a first set of bolts mounted through the first flat plate and the board with nuts mounted on the bolts adjacent the top surface of the board and wherein a second flat plate covers the first flat plate opposite the board.

4. The assembly of claim 3 wherein the securing means is a second set of bolts with nuts to secure the plates and board together.

5. The assembly of claim 4 wherein the plates and board are rectangular with four corners and wherein the second set of bolts are mounted at the corners to secure the plates and board together.

6. The assembly of claim 3 wherein the second flat plate has openings leading to heads on the first set of bolts for the terminals mounted through the first flat plate.

7. The assembly of claim 6 wherein the connector has extensions on opposite sides and wherein a third set of bolts are mounted through the extensions and the first and second plates with nuts on the third set of bolts to secure the connector in position relative to the board.

8. A mounting assembly and a relay which comprises:
(a) a flat printed circuit board with multiple terminals mounted around a periphery of the board extending upward from a top surface of the board, each terminal having a lead converging around a central portion of the board and ending at an opening in the board with a conductive material around each opening, wherein the terminals are a set of bolts mounted through the support means and board with nuts mounted on the bolts adjacent the top surface of the board;
(b) an electrical connector with pins extending from a first side of the connector and sockets for mounting the relay on an opposite second side of the connector, the pins being secured in the openings in the board by the conductive material, wherein there is a space between the top surface of the board and the first side of the connector allowing passage of air to cool the pins wherein the relay controls a gas turbine used to power an electric generator or gas compressors;

(c) a non-conductive support means mounting the board on a bottom surface of the board opposite the connector; and (d) a securing means for holding the support means and board together.

9. The assembly of claim 8 wherein the relay controls oil pumps, safety systems, fuel systems, start up of gas turbines, both generators and compressors, shut down, and the operation of the generators and compressors.

* * * * *

UNITED STATES PATENT AND TRADEMARK OFFICE

CERTIFICATE OF CORRECTION

PATENT NO. : 5,310,351

DATED : May 10, 1994

INVENTOR(S) : Theodore McAdow and Ralph G. Dennett

It is certified that error appears in the above—identified patent and that said Letters Patent is hereby corrected as shown below:

Column 2, line 25, after "17B" and before "and", the following should be inserted --of the printed circuit board 17 with terminal ports 22--.

Column 3, line 35, "bolts 23" should read --bolts 23A--.

Signed and Sealed this

Thirtieth Day of August, 1994

Bruce Lehman

*Attest:*

BRUCE LEHMAN

*Attesting Officer*

*Commissioner of Patents and Trademarks*